US008257897B2

(12) United States Patent
Kazmaier et al.

(10) Patent No.: US 8,257,897 B2
(45) Date of Patent: Sep. 4, 2012

(54) TONERS WITH FLUORESCENCE AGENT AND TONER SETS INCLUDING THE TONERS

(75) Inventors: Peter M. Kazmaier, Mississauga (CA); Gabriel Iftime, Mississauga (CA); Daryl W. Vanbesien, Burlington (CA); Edward G. Zwartz, Mississauga (CA); Shen-ge Wang, Fairport, NY (US); Reiner Eschbach, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 934 days.

(21) Appl. No.: 12/234,110

(22) Filed: Sep. 19, 2008

(65) Prior Publication Data

US 2010/0075241 A1 Mar. 25, 2010

(51) Int. Cl.
*G03G 13/20* (2006.01)
*G03G 9/08* (2006.01)

(52) U.S. Cl. ..... 430/124.1; 430/45.51; 430/10

(58) Field of Classification Search ..... 430/45.51, 430/124.1, 10
See application file for complete search history.

(56) References Cited

U.S. PATENT DOCUMENTS

| | | | |
|---|---|---|---|
| 5,128,525 | A | 7/1992 | Stearns et al. |
| 5,168,147 | A | 12/1992 | Bloomberg |
| 6,063,827 | A | 5/2000 | Sacripante et al. |
| 6,673,500 | B1 | 1/2004 | Patel et al. |
| 6,970,259 | B1 | 11/2005 | Lunt et al. |
| 7,312,011 | B2 | 12/2007 | Patel et al. |
| 7,329,476 | B2 | 2/2008 | Sacripante et al. |
| 2006/0216626 | A1 | 9/2006 | Sacripante et al. |
| 2007/0231725 | A1 | 10/2007 | Riley et al. |
| 2007/0262579 | A1 | 11/2007 | Bala et al. |
| 2008/0107990 | A1 | 5/2008 | Field et al. |
| 2008/0110995 | A1 | 5/2008 | Iftime et al. |
| 2008/0193869 | A1 | 8/2008 | Vanbesien et al. |
| 2009/0047593 | A1 | 2/2009 | Vanbesien et al. |
| 2009/0061349 | A1 | 3/2009 | Sacripante et al. |
| 2009/0214972 | A1 | 8/2009 | Wosnick et al. |

FOREIGN PATENT DOCUMENTS

| | | | |
|---|---|---|---|
| EP | 1 837 708 | A1 | 9/2007 |
| EP | 1837708 | A1 * | 9/2007 |
| JP | A 10-107970 | | 4/1998 |
| JP | A 2004-037563 | | 2/2004 |
| JP | A 2004-037564 | | 2/2004 |

OTHER PUBLICATIONS

Canadian Office Action mailed Apr. 12, 2011, issued in Canadian Patent Application No. 2,678,386.
Wosnick et al., U.S. Appl. No. 11/837,585, filed Aug. 13, 2007.
Iftime et al., U.S. Appl. No. 12/634,979, filed Dec. 10, 2009.
Kazmaier et al., U.S. Appl. No. 12/724,582, filed Mar. 16, 2010 as a Continuation-in-Part of the present application.
European Search Report mailed Jan. 19, 2010.
Office Action dated May 9, 2012 in U.S. Appl. No. 12/724,582.

* cited by examiner

*Primary Examiner* — Christopher Rodee
*Assistant Examiner* — Jonathan Jelsma
(74) *Attorney, Agent, or Firm* — Oliff & Berridge, PLC

(57) ABSTRACT

A toner set includes a plurality of toners, at least one toner but less than all toners of the toner set including binder, colorant and fluorescence agent and remaining additional toners including binder, colorant and free of fluorescence agent. At least a first toner grouping and a second toner grouping of the toner set form a combination, the first and second groupings of the combination exhibiting a substantially same color under ambient light conditions upon image formation. The first toner grouping and the second toner grouping of the combination contain a different amount of the fluorescence agent, wherein upon exposure to activating energy, the fluorescence agent fluoresces to cause a visible change in the color of a pattern formed in an image by the first toner grouping as compared to the second toner grouping.

8 Claims, No Drawings

TONERS WITH FLUORESCENCE AGENT AND TONER SETS INCLUDING THE TONERS

BACKGROUND

Described herein is a set of toners, in which the set includes at least two different toner groupings forming a combination that is capable of exhibiting a substantially same color under ambient light conditions and in which at least one but less than all of the toners of the toner set includes some amount of a fluorescence agent, wherein upon exposure to activating energy, the fluorescence agent fluoresces to cause a visible change in the color of the toner grouping having the at least one toner containing the fluorescence agent.

A number of advantages are associated with the various embodiments described herein. For example, the toners with the fluorescence agent may be used to include security features in a document, including features to verify the authenticity of the document and/or to include digitally stored, machine readable or encrypted information in the document. Another advantage is represented by the possibility of printing customized security content on various forms and documents, a process known as Variable Data Printing, which is enabled by digital printing of security features. This is advantageous because it makes counterfeiting very difficult because each printed document must be attempted to be copied individually. The security information may be hidden in the document until exposed to activating energy or radiation such as UV light that causes the fluorescence agent to illuminate or fluoresce. The security information can then be viewed to verify the authenticity, or can be machine read to decode digitally stored encrypted information. The security information cannot be copied with existing photocopiers. Other advantages include that the two toner combinations may be made to exhibit the substantially same color in ambient light conditions, such that the presence of hidden information cannot be detected until exposed to the activating energy to initiate fluorescence, whereby at least one of the two toner combinations changes color to render the hidden information viewable/readable. Other advantages are apparent from the description herein.

REFERENCES

U.S. Pat. No. 7,312,011, incorporated herein by reference in its entirety, describes a toner that includes a toner binder of crystalline sulfonated polyester, wherein the crystalline sulfonated polyester is 90% by weight or more of the toner binder, and a colorant. The toner may also include a linear amorphous sulfonated polyester, with the crystalline sulfonated polyester being from about 20% to about 60% by weight of the toner binder and the linear amorphous sulfonated polyester being from about 40% to about 80% by weight of the toner binder. The toners possess excellent minimum fixing temperatures in the range of from about 80° C. to about 130° C. Processes for preparing the toners are also described.

U.S. Pat. No. 6,673,500 describes a process comprising applying a toner security mark on a document generated by xerographic means, and which mark possesses white glossy characteristics. The toner is comprised of a waterborne polymer resin and a colorant, and optionally a second security mark generated by a toner comprised of a waterborne polymer resin and a UV fluorescent component.

U.S. patent application Ser. No. 11/837,585, incorporated by reference herein in its entirety, describes a luminescent ink marking material that includes a luminescent material, which includes quantum dots, and a vehicle for delivering the luminescent material to an object. Also described is a method of embedding information on a substrate that includes assigning information to luminescent material, which includes quantum dots, forming luminescent marking material by combining luminescent material and marking material, and creating an image on a substrate with the luminescent marking material. A system that embeds and recovers information on a substrate includes an image forming device containing such a luminescent marking material for forming an image on the a substrate and a document reading device including a radiation emitting unit, which emits radiation that causes the luminescent marking material to illuminate, and a reader that detects the data on the substrate while the luminescent marking material is illuminated, is also described.

U.S. Patent Application Publication No. 2008/0110995, incorporated by reference herein in its entirety, describes a method of embedding machine readable information on a substrate, including converting the information to machine readable code format and writing, the machine readable code format on the substrate with at least one fluorescent marking material. Also disclosed is a system for embedding and recovering machine readable information on a substrate, including an image forming device containing at least one fluorescent marking material, wherein the image forming device receives data representative of the machine readable information, and forms an image corresponding to the data in a machine readable code format with the at least one fluorescent marking material on an image receiving substrate, and a document reading device including a radiation emitting unit that emits radiation effecting fluorescence of the at least one fluorescent marking material, and a reader that detects the data in the image on the mage receiving substrate while the at least one fluorescent marking material is fluorescing.

U.S. Patent Application Publication No. 2007/0262579, incorporated by reference herein in its entirety, describes a watermark embedded in an image that has the property of being relatively indecipherable under normal light, and yet decipherable under UV light. The fluorescent mark comprises a substrate containing optical brightening agents, and a first colorant mixture pattern printed as an image upon the substrate. The colorant mixture pattern layer has as characteristics a property of strongly suppressing substrate fluorescence, as well as a property of low contrast under normal illumination against the substrate or a second colorant mixture pattern printed in close spatial proximity to the first colorant mixture pattern. The second colorant mixture pattern having a property of providing a differing level of substrate fluorescence suppression from the first such that the resultant image rendered substrate suitably exposed to an ultra-violet light source will yield a discernable image evident as a fluorescent mark.

Fluorescent marks such as described in U.S. Patent Application Publication No. 2007/0262579 are an excellent security feature. As the four colors cyan, yellow, magenta and black are typically used to determine the color space, there are many color combinations in the color space for providing exactly the same color. Fluorescent marks can take advantage of this by using two different color combinations to provide exactly the same color, but which have very different UV behavior. This may be done by controlling the paper area coverage and creating a high fluorescent signal for combinations that expose the maximal amount of paper. This combination provides a uniform color to the viewer under visible light, but under black light, fluorescence from the paper provides a visible graphic or text image. The security image is able to contain variable data through the use of "patternink" constructs in standard Page Description Languages.

However, fluorescent marks depend on the presence of fluorescence agents such as optical brighteners in the substrate for the effect, and as a result may be limited in applications. For example, fluorescent marks may be limited by the inherent spectral characteristics of the pigments, and are typically used only in light colors. Toners in which fluorescence can be utilized in a manner independent of the recording media substrate are desired.

SUMMARY

Desirable would be an enhanced security toner package that includes a toner capable of functioning as a standard toner but that includes enhanced fluorescent attributes and can be useable in nearly all colors, including dark colors such as black.

Disclosed herein is a toner set comprised of a plurality of toners. At least one, but not all, of the toners of the toner set is comprised of binder, colorant and fluorescence agent, and remaining additional toners are comprised of binder, colorant and free of fluorescence agent. At least a first toner grouping and a second toner grouping of the toner set form a combination that exhibits a substantially same color under ambient light conditions upon image formation. The first toner grouping and the second toner grouping contain a different amount of the fluorescence agent, wherein upon exposure to activating energy, the fluorescence agent fluoresces to cause a visible change in the color of a pattern formed in an image by the first toner grouping as compared to the second toner grouping.

Also disclosed is an emulsion aggregation toner comprising a toner binder, a black pigment, and a lanthanide fluorescence agent.

Also disclosed is a method of forming an image, comprising, with a toner set as described above and herein, forming a latent image of a first pattern on a photoreceptor, developing the first pattern with the first toner grouping, and subsequently transferring the developed first pattern to a recording medium, and forming a latent image of a second pattern on a photoreceptor, developing the second pattern with the second toner grouping, and subsequently transferring the developed second pattern to the recording medium.

EMBODIMENTS

Described herein are toners, and in particular emulsion aggregation toners, that contain a fluorescence agent that upon exposure to activating energy to which the fluorescence agent is sensitive results in a bright emissive image of a color different from a color exhibited under ambient light conditions by an image formed by the toners. Images formed from the toners and under ambient light conditions may exhibit a substantially same color and gloss response as that of an image formed from a similar toner but not containing the fluorescence agent. The toners containing the fluorescence agent may thus be used to form a toner set, enabling security features to be formed in an image derived from the set of toners.

Desirably, the toner set includes a number of toners, such as at least two toners, for example from two to ten toners, from two to five toners or from two to four toners, wherein a substantially same color is achievable by at least two different groupings of toners of the toner set. A combination refers to, for example, separate groupings of toners, with each grouping comprised of one or more toners of the toner set. In a full color system, typically at least four differently colored toners are used in the toner set, one for each of cyan (C), yellow (Y), magenta (M) and black (K). Multiple distinct toner combinations of the toner set may be used to achieve a same color. In color printing, this is often referred to as metamerism, where different cyan, magenta, yellow and black toners are used to print a color image and various different CMYK combinations generally result in the same color to a human observer. For example, a first toner grouping of cyan, yellow and magenta toners in the correct ratio, for example each at 33.33%, can form the same black color as the black toner (which would comprise the second toner grouping). In this example, then, the toner combination achieving the same color would comprise the first grouping of cyan, yellow and magenta toners and the second grouping of black toner. Of course, if the toner set includes two toners of the same color, for example one black toner containing a fluorescence agent and one black toner free of fluorescence agent, then these two toners can each be used to achieve the same color. Thus, for a non-full color system, two toners are typically included, each of the same color, and the toner combination comprises a first grouping of the first black toner and a second grouping of the second black toner.

In the toner sets herein, at least one toner but less than all toners of the toner set is comprised of binder, colorant and fluorescence agent, and optionally more than one toner of the toner set is also comprised of binder, colorant and fluorescence agent, with remaining additional toners of the toner set comprised of binder, colorant and free of fluorescence agent. At least a first grouping of toners and a second grouping of toners of the toner set form a combination that exhibits a substantially same color under ambient light conditions upon image formation, but the first toner grouping and the second toner grouping containing a different amount of the first toner so as to contain differing amounts of the fluorescence agent. A combination for achieving a given or predetermined substantially same color must contain differing amounts of the fluorescence agent so as to be measurably or detectably different upon exposure to activating energy. This can be achieved by several formulations as described herein, for example by (1) a toner combination achieving a substantially same color wherein the first grouping includes fluorescence agent and the second grouping does not include fluorescence agent or (2) a toner combination achieving a substantially same color wherein both groupings contain fluorescence agent but the first grouping includes an amount of fluorescence agent different from the amount of fluorescence agent in the second grouping.

In a first embodiment, the toner combination achieving a substantially same color is one where the first grouping includes fluorescence agent and the second grouping does not include fluorescence agent. This may be accomplished in any suitable manner. For example, where a first toner includes fluorescence agent and all of the additional toners do not, the toner combination of substantially a same color may be such that a first grouping of the combination includes some amount of the first toner so that the first grouping contains some amount of fluorescence agent and a second grouping includes only the one or more additional toners not containing fluorescence agent so that the grouping is free of fluorescence agent.

One example of this embodiment comprises a full color toner set of CMYK, where the black toner is the only toner comprising the fluorescence agent. Any of the other color toners may also be selected to contain a fluorescence agent; this example illustrates black toner for demonstration. A first grouping would comprise the black toner. A second grouping would comprise a combination of C, M and Y toners that achieves a substantially same black color. The second grouping is free of the fluorescence agent.

The toner set thus may comprise toners wherein one of the colors contains the fluorescent material without having its identical color without fluorescent materials present. This is advantageous because it reduces the number of toners. For example, one could have a set of cyan, magenta and yellow regular toners, plus a fourth toner which is black and contains fluorescent materials. Hidden messages or codes as security information can be created in this specific example in black by forming an image with a mixture of cyan, magenta and yellow to provide a first black area. The hidden message may be printed with the fourth toner, black containing fluorescent materials. Under regular viewing conditions, the print appears as a black area altogether. Under UV light, the hidden message becomes visible because it fluoresces when exposed to the activating light. Alternatively, the background can be printed with fluorescent black toner and the message can be printed with a combination of cyan, magenta and yellow providing indistinguishable black.

The toner set may also comprise toners that when formed into an image, different groupings of toners create essentially identical colors when viewed under normal lighting conditions. In this case, one of the cyan, magenta or yellow toner color contains a fluorescent material. As explained, there is more than one way of creating identical colors on a substrate. Black for example can be created by overlapping cyan, magenta and yellow, by just printing black toner, or by mixing smaller proportions of cyan, magenta and yellow with black toner. If for example magenta toner contains a fluorescent agent, then the black print having the highest amount of magenta will be the most fluorescent when exposed to UV light. Black made by using the second way (black toner only) will show no fluorescence at all and finally a print made using the third way will have a level of florescence comprised in between the first two. This approach has the advantage that it will show fluorescence even when the print is made on a dull substrate that has a low amount of optical brighteners. On such a dull substrate, fluorescent marks will not be efficient.

Another example of this first embodiment comprises a toner set including more than one toner of a same color, one of the same color toners containing a fluorescence agent and the other same color toner not containing the fluorescence agent. For example, if the toner set includes two black toners, one with fluorescence agent and one without, a first grouping would comprise the black toner with fluorescence agent and the second grouping would comprise the black toner without the fluorescence agent.

In a second embodiment, the toner combination achieving a substantially same color is where one of the groupings includes an amount of fluorescence agent different from the amount of fluorescence agent in the other grouping. The difference should be measurably detectable upon fluorescence, such that the difference can be used to form the security feature in the image. Measurably detectable refers to the difference in fluorescence being detected to be different by any suitable machine reading or sensing device, for example as are known in the art, or human.

The toner set of toner combinations that exhibit a substantially same color in an image under ambient light conditions may be used to form hidden images or information, such as characters, images or digital data, which are invisible to the naked human eye under ambient light conditions and in the absence of the activating energy. The hidden information can be revealed by exposing the image to the activating energy, thereby causing the fluorescence agent to fluoresce and exhibit a different color from the color exhibited by the portion of the image formed using the toner grouping containing a greater amount of a fluorescence agent. The advantages enabled by the toners and toner sets include an enhanced security modification that optionally permits digital information or data to be embedded in the security feature.

When the toner grouping containing the fluorescence agent in a different amount from the other toner grouping of a substantially same color, but with both groupings desirably having a substantially same gloss, both toner groupings can be used to form an image xerographically on recording media such as paper without a visible change in color to a human under normal illumination. Each of the substantially same color toner groupings can be printed in different patterns, but integrated together in the overall image. The toner grouping with the greater amount of fluorescence agent-containing toner can be used to form a pattern including hidden information. In this way, the image can be made to contain a variable emissive fluorescent feature, wherein under normal ambient light conditions, the two toner groupings making up the combination exhibit substantially the same color, but upon exposure to the activating energy for the fluorescence agent, the hidden information can be made to become visible, for example by the fluorescence agent causing the pattern to be emitted in a different color or in a more intense emission. The hidden information can thus be exposed to verify the authenticity of the image and/or document, or to reveal information embedded in the pattern as digitally stored data that may be read by a machine.

In embodiments, the toner set are emulsion aggregation toner sets comprised of a plurality of emulsion aggregation toners, the emulsion aggregation toners at least including two different groupings of toners exhibiting a substantially same color in an image viewed under ambient light conditions.

Differently colored toners exhibit a color in a formed image, that is, an absorption characteristic, different from each other. For example, if a first toner exhibits a yellow color, then a second differently colored toner will exhibit a different noticeably different (to a human observer) shade of yellow or a different color altogether, for example such as cyan or magenta A substantially same color herein refers to, for example, the two toner groupings each forming an image that has overall absorption characteristic within the visible range of wavelengths of the electromagnetic spectrum under normal, ambient light conditions, the color difference being substantially indiscernible to the naked human eye. In this regard, substantially same color may be thought of in terms of a CIELAB color space, in which the three coordinates of CIELAB represent the lightness of the color ($L^*=0$ yields black and $L^*=100$ indicates diffuse white), its position between red/magenta and green ($a^*$, negative values indicate green while positive values indicate magenta) and its position between yellow and blue ($b^*$, negative values indicate blue and positive values indicate yellow). A substantially same color may be two points on the color space wherein the values for $L^*$, $a^*$ and $b^*$ for each point are each sufficiently close, for example differing by less than a predetermined $\Delta E$ number, where in an ideal situation values below $1\Delta E$ are considered indentical to a human. However, in real world applications, this idealized value is commonly not achieved and a difference of $5\ \Delta E$ is often sufficient and in some cases even higher $\Delta E$ can be tolerate if sufficient visual distraction is encountered by the observer. Standard C, Y and M color toners absorb strongly in their respective frequency bands, but have a low absorbance outside that range. Black toner, however, has a fairly constant absorbance across the visible, the UV and the IR parts of the spectrum. Reference herein to the toners exhibiting a substantially same color refers to the color exhibited by the toners in an image formed using the toners.

Thus, at least one color of the toner set is achievable by two different groupings of toners of the set that exhibit the substantially same color. The substantially same color may be predetermined. While in embodiments the color represented by the two toner groupings is black, the two toner groupings having substantially the same color may be any color, including cyan, yellow, magenta and the like. More than one color may be selected as the substantially same color and achievable by different combinations of toner groupings of the set. In embodiments, the color represented by two toner groupings include darkly colored toners such as black, dark blue, dark gray and the like.

Each of the toners of the toner set, including two toners exhibiting substantially the same color, may be made to also exhibit substantially the same gloss in an image formed from the toners. As such, differential gloss realized such as when overcoating a formed image with a conventional clear overcoat or toner may be avoided. Gloss is a measure of an image's shininess, which should be measured after the image has been formed on a print sheet. Gloss may be measured using a Gardiner Gloss metering unit. In embodiments herein, each of the toners used in the toner set, including the two toners, are made to have substantially matched gloss. In this regard, each of the toners should achieve an image with a gloss within about 5 Gardiner gloss units (ggu) of each other, for example a gloss value within from 0 to about 5 ggus or from about 0.5 to about 3 ggus or from about 0.5 to about 2 ggus, of each other. In doing so, the formed image having fluorescent capabilities exhibits substantially no differential gloss, and thus the appearance of the image is uniform. The gloss exhibited by the toners herein may be stable across the fusing temperature range, and may be about 5 to about 75 Gardner gloss units (ggu), such as about 25 to about 50 ggu, as measured at 75°, over a range of about 90° C. to about 210° C. fusing temperatures.

In embodiments, the binder of a first toner containing fluorescence agent is the same as the binder of the additional toners of the toner set that are free of fluorescence agent. Where the toner set includes two toners of the same color, the colorants, such as pigments, of these two toners may be the same.

A first toner grouping of the two toner groupings may contain a fluorescence agent and the second toner grouping be substantially free of a fluorescence agent, in which case the first toner grouping color will change upon exposure to activating energy, or the first toner grouping may include a fluorescence agent that is different in amount or type from the fluorescence agent in a second toner grouping such that upon exposure to the activating energy for the fluorescence agent, the first toner grouping and the second toner grouping exhibit a visibly different color or emission from each other.

For all of the toners of the toner set, examples of toners herein include toners that exhibit certain performances related to storage stability, and particle size integrity, that is, it is desired to have the particles remain intact and not agglomerate until they are fused on paper. Since environmental conditions vary, the toners also should not substantially agglomerate up to a temperature of from about 50° C. to about 55° C. The toner composite of resins and colorant should also display acceptable triboelectrification properties that vary with the type of carrier or developer composition.

The toners desirably exhibit a fixing temperature onto paper such as of from about 90° C. to about 210° C., for example from about 90° C. to about 150° C. The lower the fusing temperature, the less power consumption required and the fuser system is able to possess extended lifetimes. For a noncontact fuser, that is a fuser that provides heat to the toner image on paper by radiant heat, the fuser usually is not in contact with the paper and the image. For a contact fuser, that is a fuser which is in contact with the paper and the image, the toners should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Fixing performance of a toner can be characterized as a function of temperature. The maximum temperature at which the toner does not adhere to the fuser roll is called the hot offset temperature (HOT). When the fuser temperature exceeds HOT, some of the molten toner adheres to the fuser roll during fixing and is transferred to subsequent substrates containing developed images, resulting for example in blurred images. This undesirable phenomenon is called offsetting. Less than the HOT of the toner is the minimum fixing temperature (MFT) of the toner, which is the minimum temperature at which acceptable adhesion of the toner to the support medium occurs, that is, as determined by, for example, a crease test. The difference between MFT and HOT is called the fusing latitude of the toner, that is, the temperature difference between the fixing temperature and the temperature at which the toner offsets onto the fuser. The fusing latitude should be as large as possible.

Toners herein may exhibit a minimum fixing temperature of from about 90° C. to about 150° C. The toners may exhibit a glass transition temperature of from about 45° C. to about 75° C. The present toners exhibit satisfactory properties when used in a xerographic or electrostatographic process. Such properties may include the gloss discussed above, good C-zone and A-zone charging, a fusing latitude of from about 15 to about 100° C., and substantially no vinyl offset.

The toners are each comprised of small sized toner particles, such as having average particle sizes of from about 3 to about 12 microns, such as from about 5 to about 9 microns. Toners with the aforementioned small sizes may be economically prepared by chemical processes, which involves the direct conversion of emulsion sized particles to toner composites by aggregation and coalescence. Upon aggregation and coalescence, the toner particles may have a geometric size distribution (GSD) of about 1.05 to about 1.35, such as from about 1.10 to about 1.25, where the geometric size distribution is defined as the square root of D84 divided by D16. The particles have a relatively smooth particle morphology.

In embodiments, the toners, including toners containing fluorescence agent and toners not containing fluorescence agent, may each comprise as the binder a linear amorphous resin, a branched amorphous resin, or both a linear and branched amorphous resin, together with optionally a crystalline resin. In one embodiment the binder may be comprised of amorphous polyesters optionally mixed with a crystalline polyester. The linear and/or branched amorphous resin and the crystalline resin may each be alkali sulfonated polyester resins. The alkali metal in the respective sulfonated polyester resins may independently be lithium, sodium, or potassium.

In embodiments, the binder may be comprised of about 10% to about 60% by weight, such as about 10% to about 40% by weight of the binder, of crystalline polyester, and from about 40% to about 90% by weight, such as about 60% to about 90% by weight of the binder, linear amorphous polyester. All or portions of the linear amorphous polyester may be replaced in the binder with a branched amorphous polyester. Branched herein refers to a polymer with chains linked to form a crosslinked network. For example, 10 to 100% by weight, such as 20 to 80% by weight, of the linear amorphous polyester may be replaced with a branched amorphous polyester, if desired. The inclusion of branched polyester portions may be used to impart elasticity to the binder, which improves the toner offset properties while not substantially affecting the minimum fixing temperature (MFT).

The crystalline, linear amorphous and branched amorphous polyester materials of the binder may each be the same or different in a particular toner.

The crystalline resin can possess various melting points of, for example, from about 30° C. to about 120° C., such as from about 50° C. to about 90° C. The crystalline resin may have, for example, a number average molecular weight (Mn), as measured by gel permeation chromatography (GPC) of, for example, from about 1,000 to about 50,000, and such as from about 2,000 to about 25,000. The weight average molecular weight (Mw) of the resin may be, for example, from about 2,000 to about 100,000, and such as from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resins can be prepared by the polycondensation process of reacting suitable organic diol(s) with suitable organic diacid(s) or diester(s), in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. When organic diesters are used in place of organic diacids, an alcohol byproduct should be generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride, thereof alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof.

The linear and branched amorphous polyester resins, in embodiments, possess, for example, a number average molecular weight (Mn), as measured by GPC, of from about 10,000 to about 500,000, and such as from about 5,000 to about 250,000; a weight average molecular weight (Mw) of, for example, from about 20,000 to about 600,000, and such as from about 7,000 to about 300,000, as determined by GPC using polystyrene standards; and a molecular weight distribution (Mw/Mn) of, for example, from about 1.5 to about 6, and more specifically, from about 2 to about 4.

The linear amorphous polyester resins are generally prepared by the polycondensation of an organic diol and a diacid or diester, and a polycondensation catalyst. For the branched amorphous polyester resin, the same materials may be used, with the further inclusion of a branching agent such as a multivalent polyacid or polyol.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and mixtures thereof. The amount of organic diol selected can vary, and more specifically, is, for example, from about 45 to about 52 mole percent of the resin.

Branching agents for use in forming the branched amorphous polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Examples of other suitable resins include, for example, a polymer selected from poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), combinations thereof and the like. The resins may also be functionalized, such as carboxylated, sulfonated, or the like, and particularly such as sodio sulfonated, if desired.

In addition to the aforementioned toner binders, the toners may each include at least one colorant. Various known suitable colorants, such as dyes, pigments, and mixtures thereof, may be included in the toner in an effective amount of, for example, about 1 to about 25 percent by weight of the toner, and such as in an amount of about 1 to about 15 weight percent by weight of the toner.

The at least one colorant is desirably a non-fluorescent colorant. The colorant of the toners of the toner set including a fluorescence agent must be a pigment. This is because when pigments are used for providing color, and the fluorescence agent is dispersed in the toner binder, there is always sufficient room between the pigment particles to permit light to reach the fluorescence agent. This may not always be the case when using a dye as the colorant, which are dispersed the same as the fluorescence agent in the toner binder and thus may not allow sufficient light to reach the fluorescence agent, particularly for a darkly colored toner such as a black toner. Fluorescence may thus not be properly realized.

While the colorant of toners of the toner set not containing a fluorescence agent may use a non-pigment colorant, it is desired that all toners of the toner set include a pigment colorant so that regardless of the order in which the toners are printed onto the recording media, light will be able to reach the fluorescence agent so that the desired fluorescence can be realized.

As examples of suitable colorants, mention may be made of carbon black such as REGAL 330; magnetites, such as Mobay magnetites MO08029, MO8060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As colored pigments, there can be selected cyan, magenta, yellow, red, green, brown, blue or mixtures thereof. Specific examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido)phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK, and cyan components may also be selected as colorants. Other known colorants can be selected, such as Levanyl Black A-SF (Miles, Bayer) and Sunsperse Carbon Black LHD 9303 (Sun Chemicals).

In the toners of the toner set including a fluorescence agent, the fluorescence agent is a material that responds to activating energy, such as ultraviolet or black light, to emit or fluoresce at a different color than the material exhibits at ambient light. The activating energy or radiation may be, for example a radiation source having a wavelength from about 100 nm to about 1100 nm, such as from about 150 nm to about 900 nm or from about 200 nm to about 600 nm. The activating energy may thus be in the ultraviolet (UV), visible or infrared regions, although the use of activating radiation in the UV region (from about 100 nm to about 400 nm) is most common. The fluorescence may occur instantaneously on exposure to the activating energy, or may occur after overcoming any activation phase. The fluorescence exhibited may be reversible, but should last for a time period permitting the color change or image appearance change to be detected, for example a time frame of from about 0.5 seconds to about 1 hour, such as from about 1 second to about 45 minutes or from about 5 seconds to about 30 minutes.

A total amount of the fluorescence agent in a toner grouping may comprise from about 0.1% to about 75% by weight of the total weight of the grouping. When both groupings contain an amount of the fluorescence agent, the amount of the agent in the two groupings, in order to be detectably different, may differ by at least about 3 percentage units, such as at least about 5 or 10 percentage units. Thus, if a first grouping includes 50% fluorescence agent, the second group may contain 47% fluorescence agent or less, or 53% fluorescence agent or more.

Suitable fluorescence agents include, for example, fluorescent dyes, fluorescent pigments and inorganic surface functionalized quantum dot materials. Examples of fluorescent dyes suitable for use herein include those belonging to the dye families known as rhodamines, fluoresciens, coumarins, napthalimides, benzoxanthenes, acridines, azos, mixtures thereof and the like, Suitable fluorescent dyes include, for example, Basic Yellow 40, Basic Red 1, Basic Violet 11, Basic Violet 10, Basic Violet 16, Acid Yellow 73, Acid Yellow 184, Acid Red 50, Acid Red 52, Solvent Yellow 44, Solvent Yellow 131, Solvent Yellow 85, Solvent Yellow 135, solvent Yellow 43, Solvent Yellow 160, Fluorescent Brightener 61, mixtures thereof and the like. Suitable fluorescent pigments include, but are not limited to, those available from Day-Glo Color Corp., such as aurora pink T-11 and GT-11, neon red T-12, rocket red T-13 or GT-13, fire orange T-14 or GT-14N, blaze orange T-15 or GT-15N, arc yellow T-16, saturn yellow T-17N, corona magenta GT-21 and GT-17N, mixtures thereof and the like. Other suitable fluorescent pigments available from Risk Reactor are for example PFC class, like for example PFC-03 which switches from invisible to red when exposed to UV light, PF class like for example PF-09 which switches from invisible to violet when exposed to UV light. Other suppliers of fluorescent materials include Beaver Luminescers from Newton, Mass. and Cleveland Pigment & Color Co. form Akron, Ohio.

Quantum dot materials are fluorescent inorganic semiconductor nanoparticle materials. The light emission of quantum dots is due to quantum confinement of electrons and holes. An advantage of quantum dots is that they can be tuned so that they emit any desired wavelength (color) as a function of their size, by using one material only and the same synthetic process. For example in a range comprised from about 2 to about 10 nm, one can obtain a full range of colors from the visible range of the spectrum. In addition, quantum dots possess improved fatigue resistance when compared with organic dyes. Another advantage of quantum dots is their narrow emission bands, which increases the number of possible wavelength choices for designing customized colors. Quantum dots are available from a variety of companies, such as from Evident Technologies (Troy, N.Y.).

In embodiments, the quantum dot materials used herein are functionalized quantum dots. Surface functionalized quantum dots may have better compatibility with toner materials. Suitable functional groups present on the surface of the nanoparticle quantum dots for compatibility with toner include long linear or branched alkyl groups, for example from about 1 carbon atom to about 150 carbon atoms in length, such as from about 2 carbon atoms to about 125 carbon atoms or from about 3 carbon atoms to about 100 carbon atoms. Other suitable compatibilizing groups include polyesters, polyethers, polyamides, polycarbonates and the like.

In embodiments, the fluorescence agent is a lanthanide material or complex, such as a lanthanide chelate. Examples of lanthanide chelates include those formed by the chelation of organic ligands such as acetylacetone, benzoylacetone, dibenzoylmethane, and salicylic acid with lanthanide ions such as neodymium, europium, samarium, dysprosium, terbium ions and the like. Examples of such complexes include europium acetylacetonate, samarium acetylacetonate, neodymium benzoylacetonate, terbium salicylate, and dysprosium benzoylacetonate. The above chelates absorb ultraviolet radiation and fluoresce in the visible range. For darkly colored toners, a desirable fluorescence agent is DFKY-C7, a red emitting fluorescent dye from Risk Reactor.

Other suitable fluorescent dyes include oil and solvent based dyes like DFSB class, DFWB class, DFPD class, DFSB-K class and the like available from Risk Reactor, such as DFWB-K41-80 that is red in ambient light and that fluoresces red-purple under UV light, DFSB-K401 that is red-purple in ambient light and that fluoresces red-purple under UV light, DFSB-K400 that has a brown appearance in ambient light and that fluoresces orange under excitation with UV light, DFSB-K427 that is orange under ambient light and under exposure to UV light, and DFSB-K43 that is yellow in ambient light and under exposure to activating UV light.

The fluorescence agent may be present in the toner in any suitable amount, such as from about 0.1% to about 50%, for example from about 0.5% to about 25% or about 0.5% to about 10% by weight of the toner.

In embodiments, the emulsion aggregation toner containing a fluorescence agent is a toner comprising a polyester toner binder such as described above, a black pigment, and a lanthanide fluorescence agent. The black pigment may be a carbon black. Such a toner may be used in combination with a regular standard or process black toner of a substantially same color.

The toners may include additional optional components, for example including a wax. When included, the wax may be present in an amount of from about 1 weight percent to about 25 weight percent, such as from about 5 weight percent to about 20 weight percent, of the toner. Examples of suitable waxes include polypropylenes and polyethylenes commercially available from Allied Chemical and Petrolite Corporation (for example, POLYWAX polyethylene waxes from Baker Petrolite), wax emulsions available from Michaelman, Inc. and the Daniels Products Company, EPOLENE N-15 commercially available from Eastman Chemical Products, Inc., VISCOL 550-P, a low weight average molecular weight polypropylene available from Sanyo Kasei K. K., CARNAUBA Wax and similar materials. Examples of functionalized waxes include, for example, amines, amides, for example AQUA SUPERSLIP 6550, SUPERSLIP 6530 available from Micro Powder Inc., fluorinated waxes, for example POLYFLUO 190, POLYFLUO 200, POLYSILK 19, POLYSILK 14 available from Micro Powder Inc., mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, chlorinated polypropylenes and polyethylenes available from Allied Chemical and Petrolite Corporation and SC Johnson wax.

The toners may also optionally contain positive or negative charge enhancing additives, such as in an amount of about 0.1 to about 10, or from about 1 to about 3, percent by weight of the toner. Examples of these additives include quaternary ammonium compounds inclusive of alkyl pyridinium halides; alkyl pyridinium compounds, organic sulfate and sulfonate compositions, cetyl pyridinium tetrafluoroborates; distearyl dimethyl ammonium methyl sulfate; aluminum salts such as BONTRON E84 or E88 (Hodogaya Chemical); mixtures thereof; and the like.

There can also be blended with the toner compositions external additive particles including flow aid additives, which additives may be present on the surface of the toner particles. Examples of these additives include metal oxides like titanium oxide, tin oxide, mixtures thereof, and the like; colloidal silicas, such as AEROSIL, metal salts and metal salts of fatty acids inclusive of zinc stearate, aluminum oxides, cerium oxides, and mixtures thereof. Each of the external additives may be present in an amount of from about 0.1 percent by weight to about 5 percent by weight, and more specifically, in an amount of from about 0.1 percent by weight to about 1 percent by weight, of the toner. Several of the aforementioned additives are illustrated in U.S. Pat. Nos. 3,590,000, 3,800,588, and 6,214,507, the disclosures which are totally incorporated herein by reference.

The toners may be made by a variety of known methods, but are desirably made by the known emulsion aggregation process in which small size resin particles in an emulsion including the other components of the toner are aggregated to the appropriate toner particle size and then coalesced to achieve the final toner particle shape and morphology.

The toners may be prepared by a process that includes aggregating a mixture of the polyester binder, the pigment colorant, any fluorescence agent, and any optionally wax or other desired or required additives, and then coalescing the aggregate mixture. A pre-toner mixture is prepared by adding the colorant, any fluorescence agent and optionally a wax or other materials, to the emulsion, which may be a mixture of two or more emulsions containing the toner binder resin(s). In embodiments, the pH of the pre-toner mixture is adjusted to between about 4 to about 5. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA Ultra Turrax T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent is added to the pre-toner mixture at a temperature that is below the glass transition temperature (Tg) of the emulsion resin. The aggregating agent may be added in an amount of about 0.05 pph to about 3.0 pph with respect to multivalent cation and from about 1.0 to about 10 pph with respect to the divalent cation wherein the pph is with respect to weight of toner. The aggregating agent may be added to the pre-toner mixture over a period of from about 0 to about 60 minutes. Aggregation may be accomplished with or without maintaining homogenization. Aggregation is accomplished at temperatures that are typically greater then 60° C.

In embodiments, the toner particles may have a core-shell structure, wherein the core is comprised of the binder, colorant and fluorescence agent, and the shell is comprised of additional binder and free of additional colorant. If desired, additional fluorescence agent may be included in the shell.

The toner particles of all embodiments may be formulated into a developer composition, for example by mixing the toner particles with carrier particles to achieve a two-component developer composition. The toner concentration in each developer ranges from, for example, about 1% to about 25%, such as about 2% to about 15%, by weight of the total weight of the developer. Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like.

The toners of the toner set may be applied to a recording media, such as paper, plastic, cardboard, metal and the like, using any suitable xerographic or electrostatographic printing technique.

In embodiments, any known type of image development system may be used in an image developing device to form images with the toner set described herein, including, for example, magnetic brush development, jumping single-component development, hybrid scavengeless development (HSD), and the like. These development systems are known in the art, and further explanation of the operation of these devices to form an image is thus not necessary herein. It is sufficient to say that portions of an overall image may be formed by first forming a latent image pattern for a given toner color on a photoreceptor surface, developing the latent image, and then transferring the developed pattern to a recording media in order to form that color portion of an image. The image may be assisted in being fixed to the recording media by, following transfer to the recording media, utilizing a fuser roll member. Fuser roll members are contact fusing devices that are known in the art, in which heat and pressure from the roll are used in order to fuse the toner to the recording media such as paper. Typically, the fuser member may be heated to a temperature just above the fusing temperature of the toner, such as to temperatures of from about 80° C. to about 150° C. or more.

A first toner grouping of a combination may be transferred to the recording media substrate before, during or after patterns, or images, of the second grouping are transferred to the substrate. In embodiments where the combination includes two toners of a same color, the toner with the fluorescence agent may be transferred after the transferring of the substantially same color ink without a fluorescence agent. In this way, when the toner with the fluorescence agent is made to have a pattern over at least some portions of the pattern formed by the toner without the fluorescence agent, the full desired effect of the fluorescence can be realized upon exposure to activating radiation without concern of any masking from the toner without fluorescence agent.

The fluorescence property of the fluorescence agent may be especially useful in security applications. In embodiments, the presence of the fluorescence agent is not noticeable to a viewer when viewed in ambient light, but becomes noticeable when exposed to radiation at which the fluorescence agent fluoresces. Upon the image/document being removed from exposure to the activating radiation, the fluorescence agent once again returns to a non-fluorescing state. Such a feature may be useful, for example, in authentication of documents, as a forged document or photocopy would not have the ability to fluoresce and change appearance upon exposure to the activating radiation. The change between the fluorescing state and the non-fluorescing state can be repeated an indefinite number of times, and for example from about 10 to about 100,000,000 times or more.

Also, this feature can permit one to intentionally embed hidden information in documents, which information is only revealed to one knowing to expose the document to activating energy. The hidden information may take the form of characters, text, images and the like, which forms, or patterns, are provided by the printing of the toner containing the fluorescence agent. This information can indicate and/or verify the authenticity of the image and/or document formed using the toner sets described herein.

In embodiments, the pattern formed by the toner containing the fluorescence agent may be machine readable code storing digital data in the document. Digital data refers to, for example, information such as test or numeric characters in the form of a digital code representative of zeroes and one. The machine readable code format may be, for example, one dimensional barcode, two dimensional barcode, glyphs, dots, combinations thereof and the like. One dimensional barcodes have a form such as used for UPC codes on products. The two dimensional barcode may be of any suitable type, such as, for example, PDF417 (based on stacked barcodes), 3-DI, Array Tag, Aztec code, Codablock, Code 16K, CP code, Data Matrix, Datastrip code, Maxicode, Minicode, and the like. The encoded information may also be in the form of data glyphs or dots. In glyphs code, the code format is a self-clocking glyph code as disclosed in, for example, U.S. Pat. Nos. 5,128,525 and 5,168,147, the disclosures of each of which are totally incorporated herein by reference. This code comprises printed glyphs which represent 0 and 1 bits in a document encoding scheme, such as / and \. Each symbol may represent one bit; for example, /=1 and \=0. In dot code, 0s and 1s are represented by the presence or absence of a dot. Dots refer to, for example, any mark of any shape, and includes, for example, circular or rectangular marks.

For embedding digital data in the image formed with the toner sets herein, the printer has an associated encoding device, which receives the information to be encoded and encodes the information in a suitable machine readable format. The encoded information is sent to the printer for printing onto the paper substrate using a toner containing a fluorescence agent. The device may also include a detector/reader for detecting and reading the hidden information when it is exposed by activation of the fluorescence agent. For this detection, the image is exposed to the activating energy to cause the fluorescence agent to emit light at a different color and, while still exhibiting the different color, detecting and reading the information with a detector/reader. The system may also include one or more processors, for example to convert information to the encoded information representative of the information, that is, to convert the information to a machine readable code format. A similar processor may be used to decode encoded information detected by a reader, that is, convert the encoded information to its original uncoded information form, to recover the encoded information. The decoded information may be presented to a person in human-understandable format, which can confirm the authenticity of the image and/or document as well as inform of the hidden information contained in the document. One example use of this feature may be to encode the actual amount of a check, permitting detection of checks in which the actual amount may have been altered.

As mentioned above, the toner set may include a number of colors, and the toners may be used to form other visible images on the document. The visible and hidden information images may share a same portion of the document, or the hidden information portion may be in a separate portion of the document for easy location by a person or detector/reader. Because the hidden information is a same color as one of the toner groupings achievable by the toner set, the presence of the hidden information in the image is not detectable by the naked human eye.

As the recording media, any suitable substrate material capable of being printed may be used, such as paper, plastic, cardboard, metal and the like. In embodiments, the recording media is paper. The paper may include optical brightening agents such as described in U.S. Patent Application Publication No. 2007/0262579, such that the image formed on the substrate may include the synergistic effect of the fluorescence from the fluorescence agent and the radiated fluorescence as a result of the optical brightening agent. Fluorescence marks formed on paper substrates having optical brighteners may be particularly advantageous as a result.

Embodiments described above will now be further illustrated by way of the following examples.

EXAMPLE 1

A black toner was prepared as follows:

An emulsion of fluorescent polymer particles in water is prepared as follows. 134.5 g of poly propoxylated bisphenol A-co-fumarate resin, 15.5 g of Carnauba wax and 1.5 g of DFKY-C7 lanthanide fluorescent agent (Risk Reactor) is dissolved in 1101 g of ethyl acetate at 70° C. Separately, 1.9 g of DOWFAX 2A-1 solution and 3.0 g of concentrated ammonium hydroxide is dissolved in 850.7 g of deionized water at 70° C. The ethyl acetate solution is then poured slowly into the aqueous solution under continuous high-shear homogenization (10,000 rpm, IKA Ultra-Turrax T50). After an additional 30 min of homogenization, the reaction mixture is distilled at 80° C. for two hours. The resulting emulsion is stirred overnight, strained through a 25-micron sieve, and centrifuged at 3000 rpm for 15 minutes. The supernatant is decanted will yield a strongly red-fluorescent latex, with 170 nm average particle size and about 23.5% solids.

A toner is then prepared. 316 g of the above-described latex, 32.5 g of a Nipex 35 black pigment dispersion, solids loading of 17 weight percent, 372 g of deionized water, and 1.87 g of DOWFAX 2A-1 solution is combined in a glass reactor and adjusted to pH 3.3 with 0.3 N nitric acid. The mixture is homogenized (IKA Ultra-Turrax T50, 4000 rpm) while adding a mixture of 2.2 g 10 wt % $Al_2(SO_4)_3$ and 19.8 g deionized water over one minute. The contents of the reactor is homogenized further for five minutes, and then heated from room temperature to approximately 45° C. over 30 minutes while stirring at 495 rpm, at which point a particle size of 5.04 microns is reached. A solution consisting of a further 131.8 g of the above-described latex and 0.72 g of DOWFAX 2A-1 solution is then added to the reactor, the pH re-adjusted to 3.3 with 0.3 N nitric acid, and the stirring rate reduced to 385 rpm, in order to form a shell around the aggregated core. The reactor temperature is raised by 3° C. over approximately 30 minutes, at which point a particle size of 6.02 microns is reached. The pH of the solution is then adjusted to 7.5 and the stirring rate reduced to 200 rpm. The reactor temperature is then increased to 70° C. over approximately 40 minutes, and five drops of DOWFAX 2A-1 solution is added. The reaction mixture is maintained at 70-75° C. for three hours, providing toner particles with a particle size of 6.21 microns. After cooling to room temperature, the mixture is strained through a 20-micron metal sieve, filtered and dried. The toner is re-suspended in deionized water for 40 minutes, re-filtered, re-suspended in water at 40° C. and pH 4.0 for 40 minutes, re-filtered, and re-suspended in water a final time. The suspension is filtered and lyophilized, providing black toner particles which when exposed to UV light show brightly red-fluorescent particles of size about 5.90 microns, GSD about 1.25, and circularity around 0.950.

A similar black toner was prepared, except omitting the fluorescent dye, the toner having the same effective percentage of carbon black as the above toner.

An image is then formed xerographically with the toners. A large black color rectangle is first formed on a paper substrate with the toner not containing the fluorescent dye. The text "security message" is then transferred to the substrate, within the previously formed black rectangle, using the toner containing the fluorescent dye. Under ambient light, all that is visible is a black rectangle. Upon exposure to black light, the words "security message" appear in red within the black triangle where formed with the toner containing the fluorescent dye.

COMPARATIVE EXAMPLE 1

A black toner containing a fluorescent dye as above is prepared as above, but using a black dye colorant in place of the black pigment colorant.

Upon forming an image on a paper substrate and exposure to black light, no color change or fluorescence is observed. This is believed to be because the black dye, unlike the black pigment, obscures the activating energy from reaching the fluorescence agent, thereby suppressing the fluorescence.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of forming an image, comprising:

with a toner set comprised of a plurality of toners, at least one toner but less than all toners of the toner set comprising binder, colorant and fluorescence agent and remaining additional toners comprised of binder, colorant and free of fluorescence agent, wherein at least a first toner grouping and a second toner grouping of the toner set form a combination, the first and second groupings of the combination exhibiting a substantially same color and a substantially same gloss under ambient light conditions upon image formation, the first toner grouping and the second toner grouping of the combination containing a different amount of the fluorescence agent, wherein upon exposure to activating energy, the fluorescence agent fluoresces to cause a visible change in the color of a pattern formed in an image by the first toner grouping as compared to the second toner grouping, forming a latent image of a first pattern on a photoreceptor, developing the first pattern with the first toner grouping, and subsequently transferring the developed first pattern to a recording medium, and forming a latent image of a second pattern on a photoreceptor, developing the second pattern with the second toner grouping, and subsequently transferring the developed second pattern to the recording medium.

2. The method according to claim 1, wherein the second pattern is transferred to the recording medium after the first pattern is transferred.

3. The method according to claim 1, wherein at least portions of the second pattern are formed over portions of the first pattern.

4. The method according to claim 1, further comprising exposing the image to the activating energy to initiate fluorescence of the fluorescence agent in the first and/or second pattern.

5. The method according to claim 4, wherein upon fluorescence, the first pattern exhibits a color different from the color exhibited by the second pattern.

6. The method according to claim 1, wherein the first pattern or the second pattern includes the fluorescence agent and is comprised of digital information.

7. The method according to claim 6, wherein the digital information is machine readable, and the method further comprises exposing the image to the activating energy to initiate fluorescence of the fluorescence agent in the first or the second pattern and reading the digital information with a machine during the fluorescence.

8. The method according to claim 1, wherein either the first pattern or the second pattern comprises information indicating the authenticity of the image.

* * * * *